US012758075B2

(12) United States Patent
Sun et al.

(10) Patent No.: US 12,758,075 B2
(45) Date of Patent: Oct. 13, 2026

(54) CLEANING DEVICE AND CONTROL METHOD THEREOF

(71) Applicant: Shenzhen Inxni Innovation Technology Co., Ltd., Shenzhen (CN)

(72) Inventors: Huajun Sun, Shenzhen (CN); Lirong Ye, Shenzhen (CN)

(73) Assignee: SHENZHEN INXNI INNOVATION TECHNOLOGY CO., LTD., Shenzhen (CN)

( * ) Notice: Subject to any disclaimer, the term of this patent is extended or adjusted under 35 U.S.C. 154(b) by 20 days.

(21) Appl. No.: 18/797,542

(22) Filed: Aug. 8, 2024

(65) Prior Publication Data

US 2025/0235067 A1 Jul. 24, 2025

Related U.S. Application Data

(63) Continuation of application No. PCT/CN2024/081894, filed on Mar. 15, 2024.

(30) Foreign Application Priority Data

Jan. 23, 2024 (CN) ..... 202410095413.6

(51) Int. Cl.
*A47L 11/40* (2006.01)
*A47L 11/283* (2006.01)

(52) U.S. Cl.
CPC ..... *A47L 11/4069* (2013.01); *A47L 11/283* (2013.01); *A47L 11/4011* (2013.01); *A47L 11/4038* (2013.01)

(58) Field of Classification Search
CPC ..... A47L 11/4052; A47L 11/4055; A47L 11/4069; A47L 11/4058; A47L 11/282–284
See application file for complete search history.

(56) References Cited

FOREIGN PATENT DOCUMENTS

| | | | | |
|---|---|---|---|---|
| CN | 113287975 A | | 8/2021 | |
| CN | 114916868 A | * | 8/2022 | ..... A47L 11/24 |
| CN | 117084597 A | | 11/2023 | |

(Continued)

OTHER PUBLICATIONS

International Search Report of PCT Patent Application No. PCT/CN2024/081894 issued on Jul. 31, 2024.

*Primary Examiner* — Laura C Guidotti
(74) *Attorney, Agent, or Firm* — Andrew C. Cheng

(57) ABSTRACT

A cleaning device includes a chassis defining a trough; a first drive mechanism; a rotating plate fitted in the trough, a cleaning plate eccentrically mounted on the rotating plate, the rotating plate being provided with a transmission structure, an input end of the transmission structure being in transmitting connection with the first drive mechanism, an output end of the transmission structure being in transmitting connection with the cleaning plate to drive the cleaning plate to rotate; a second drive mechanism connected with the rotating plate for driving the rotating plate to rotate and thereby driving the cleaning plate to move for displacement. The trough allows the rotating plate to be fitted therein and the trough is shielded by the rotating plate to prevent contaminants from passing through the trough to get into the cleaning device, reducing occurrence of a situation of contaminant depositing and hiding in the transmitting connection site.

19 Claims, 8 Drawing Sheets

(56) References Cited

FOREIGN PATENT DOCUMENTS

| | | | | | |
|---|---|---|---|---|---|
| CN | 220089389 | U | * | 11/2023 | ..... A47L 11/40 |
| CN | 117338207 | A | | 1/2024 | |
| CN | 117357012 | A | * | 1/2024 | ..... A47L 11/4038 |
| KR | 20160072309 | A | | 6/2016 | |
| KR | 20230011583 | A | | 1/2023 | |

* cited by examiner

A-A

CLEANING DEVICE AND CONTROL METHOD THEREOF

CROSS-REFERENCE TO RELATED APPLICATIONS

The present application is a continuation application of International Application No. PCT/CN2024/081894, filed on Mar. 15, 2024, which is based upon and claims the priority of Chinese Patent Application No. 202410095413.6, titled "Cleaning Device and Control Method Thereof", filed with China National Intellectual Property Administration on Jan. 23, 2024, and the contents thereof are incorporated herein in the entirety thereof for reference.

TECHNICAL FIELD

The present invention relates to the technical field of intelligent cleaning equipment, and more particularly to a cleaning device and a control method thereof.

BACKGROUND OF THE ART

A cleaning robot is an intelligent cleaning equipment that is movable on a surface-to-be-cleaned and carries out a cleaning operation. In a known dual cleaning rotating plate floor-mopping mode, there is an area of a certain width along a wall that cannot be reached with the mop, and manual cleaning is required, and thus, the effect of cleaning is poor. In the existing technology, an oscillating mechanism that is configured to drive the cleaning rotating plate to move for displacement requires a displacement avoidance trough formed in a bottom of the robot to avoid the movement trace occurring during the displacement of the cleaning rotating plate. This may result in deposition of debris, such as dust and hairs, in the avoidance trough during the cleaning process to inevitably increase the burden of a user for cleaning.

SUMMARY OF THE INVENTION

An embodiment of the present disclosure provides a cleaning device which includes a chassis being recessed to form a trough; a first drive mechanism being mounted on the chassis; a rotating plate and a cleaning plate, the rotating plate being fitted to and mounted on the trough, the cleaning plate being eccentrically mounted on the rotating plate, the rotating plate being provided with a transmission structure, an input end of the transmission structure being in transmitting connection with the first drive mechanism, an output end of the transmission structure being in transmitting connection with the cleaning plate to drive the cleaning plate to rotate; a second drive mechanism, the second drive mechanism being connected with the rotating plate. Driven by the second drive mechanism, the rotating plate is caused to rotate about an axis of the rotating plate, so that the rotating plate drives, through rotation thereof, the cleaning plate to move for displacement.

Another embodiment of the present disclosure provides a control method of the above-mentioned cleaning device. The control method comprises the following step: supplying electrical power to the first drive mechanism according to a first mode instructed by a mode instruction to allow the transmission structure, on the basis of being driven by the first drive mechanism, to drive the cleaning plate to rotate, and/or supplying electrical power to the first drive mechanism and the second drive mechanism according to a second mode instructed by a mode instruction to allow the transmission structure, on the basis of being driven by the first drive mechanism, to drive the cleaning plate to rotate and the rotating plate, on the basis of being driven by the second drive mechanism, driving the cleaning plate to move for displacement.

DETAILED DESCRIPTION OF PREFERRED EMBODIMENTS

The present invention provides a cleaning device and a control method thereof. To make the objectives, technical solutions, and efficacy of the present invention clear and precise, the following provides a detailed description of the present invention with reference to the attached drawings and embodiments. It is appreciated that the specific embodiments described herein are provided only for illustrating the present invention and are not intended to limit the scope of protection for the present invention.

In the description of the present invention, it is noted that the terms "up", "down", "inside", and "outside" indicate a directional or positional relationship that is based on the directional or positional relationship illustrated in the attached drawings and are applied only for easing the description of the present invention and simplifying the illustration, and are not for indicating or implying the device or element designated thereby must have a specific direction or must be constructed or operated in a specific direction, and thus should not be construed as limiting to the present invention.

In the description of the present invention, it is noted that, unless explicitly specified and defined otherwise, the terms, "mounting", "interconnecting", and "connecting" should be interpreted in a broad sense, for example being fixedly connected or detachably connected, or integrally connected; or being mechanically connected or electrically connected or being in communication with each other; or being directly connected or indirectly connected through an intermediate medium, or being connected of interiors of two elements or being of an interactive relationship between two elements. For those having ordinary skill in the field, specific contents of the above terms as used in the present invention can be construed according to a practical situation.

Figure 1:
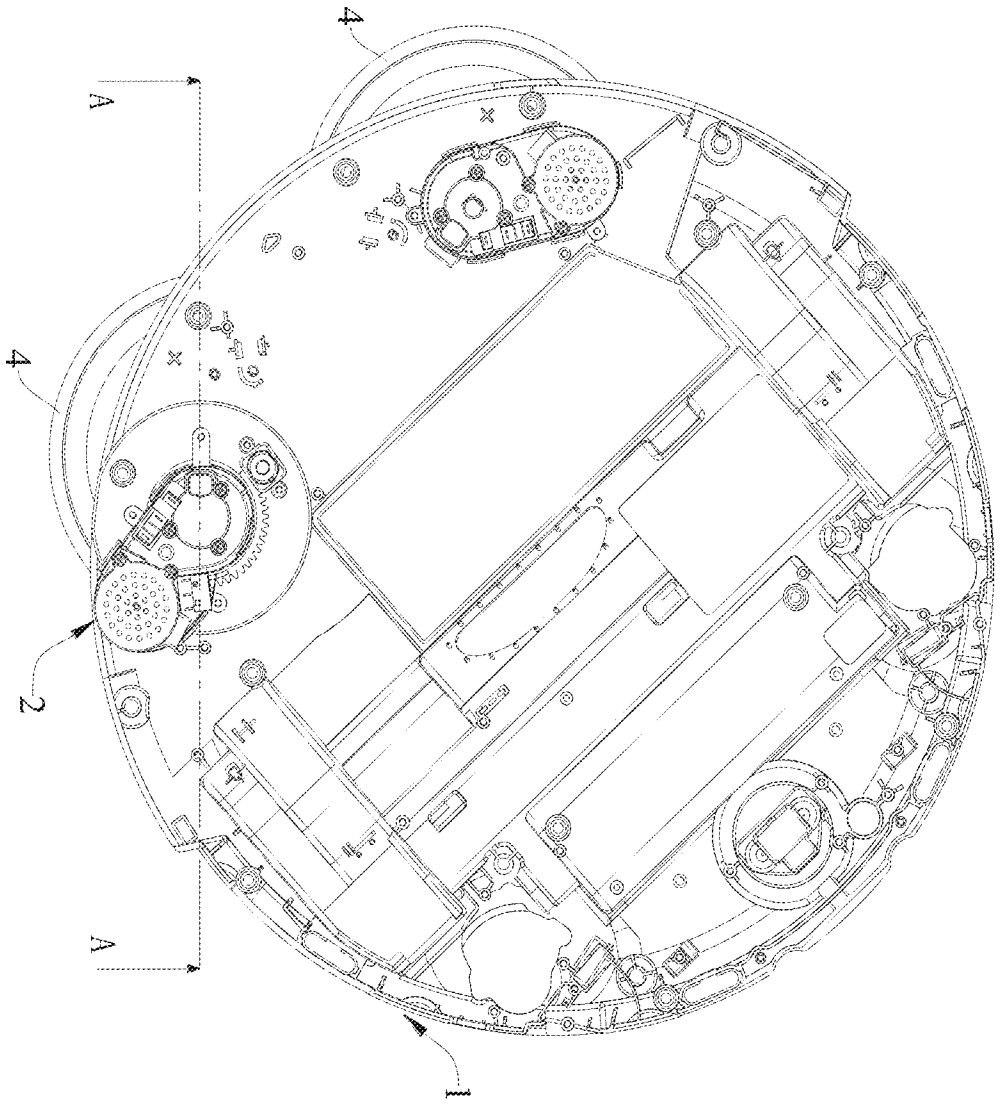
FIG. 1 is a schematic view showing a cleaning device according to an embodiment of the application.
Figure 2:
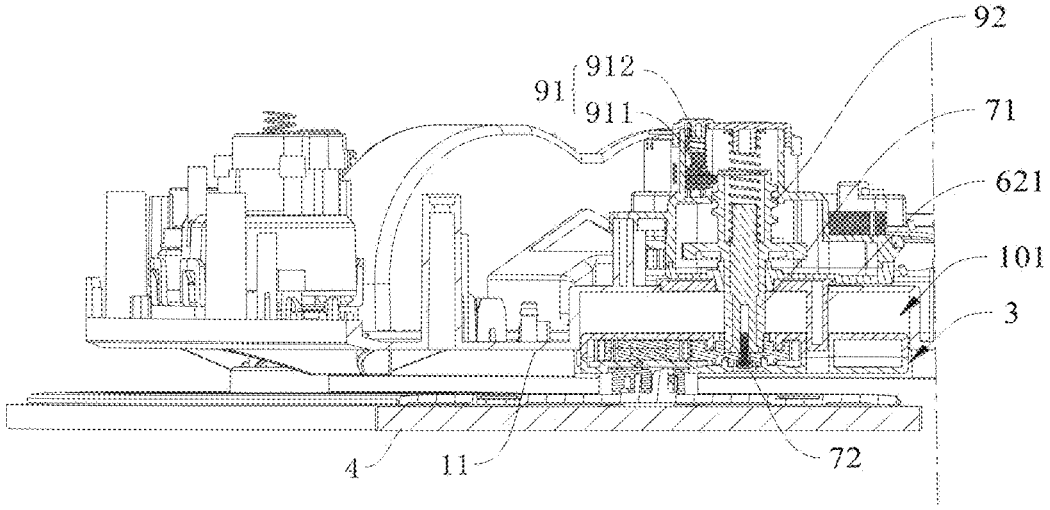
FIG. 2 is a schematic cross-sectional view taken along line A-A of FIG. 1.
Figure 3:
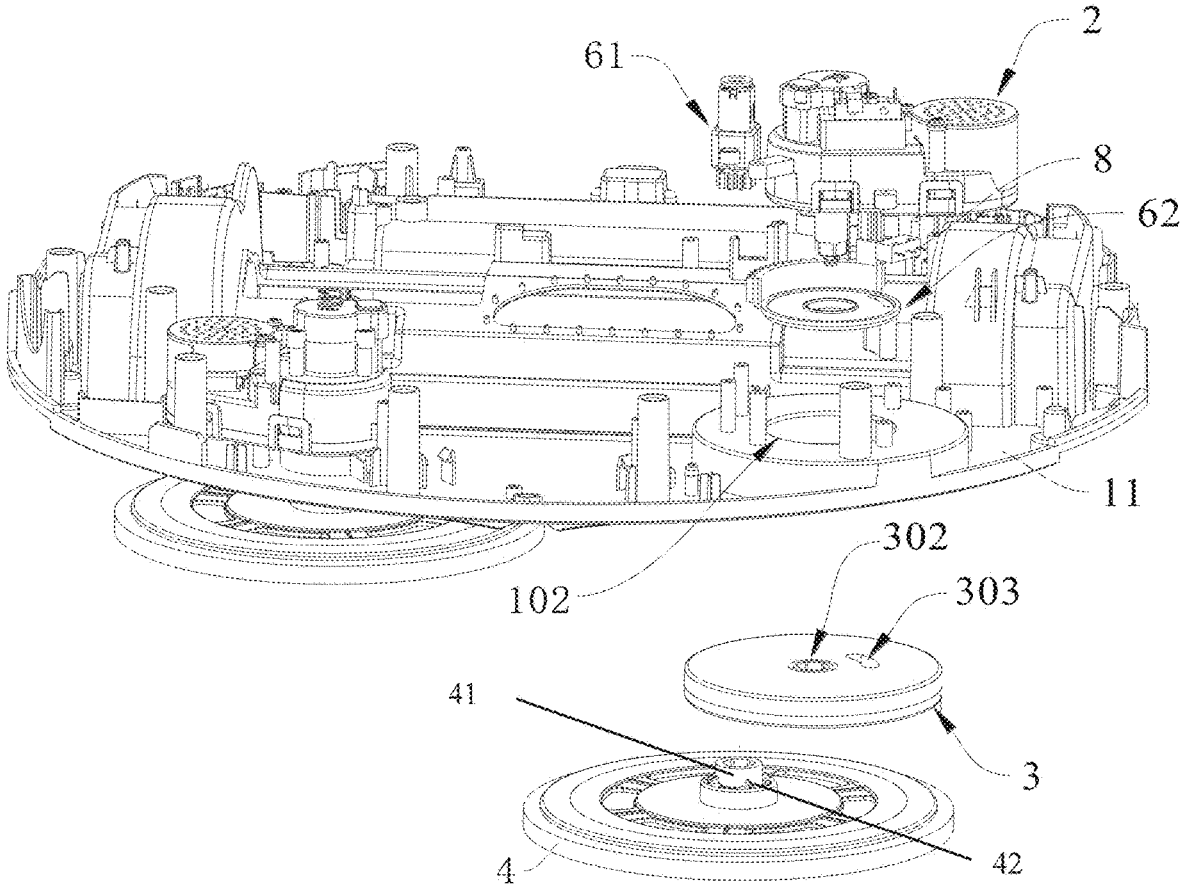
FIG. 3 is an exploded view showing a cleaning device according to an embodiment of the application.

It is learned, from a combination of FIGS. 1, 2, and 3 that, in one aspect, the present invention provides, in an embodiment, a cleaning device, and understandably, the cleaning device can be an intelligent cleaning robot that is movable on a surface-to-be-cleaned and carries out a cleaning operation. The cleaning device in the present application, can be a sweeping robot, a mopping robot, or a machine that integrates various functions of cleaning. The cleaning device comprises a chassis 1, a first drive mechanism 2, a rotating plate 3, a cleaning plate 4, and a second drive mechanism 6.

The chassis 1 is recessed to form a trough 101. The chassis 1 serves as a bottom carrying structure of the cleaning device. The first drive mechanism 2 is mounted on the chassis 1 in order to prevent the first drive mechanism 2 from being directly exposed outside of the cleaning device. The chassis 1 provides a mounting site for the first drive mechanism and provides an effect of protection to the first drive mechanism 2.

The rotating plate 3 is fitted to and mounted in the trough 101, and the cleaning plate 4 is mounted eccentrically to the rotating plate 3. A transmission structure 5 is arranged on the rotating plate 3. An input end of the transmission structure 5 is in transmitting connection with the first drive mechanism 2, and an output end of the transmission structure 5 is in transmitting connection with the cleaning plate 4 to drive the cleaning plate 4 to rotate.

In the above, the transmission structure 5 is arranged on the rotating plate 3 and the transmission structure 5 is in transmitting connection between the first drive mechanism 2 and the cleaning plate 4 so as to drive the cleaning plate 4 to rotate to realize a cleaning process for cleaning the ground. Understandably, the rotating plate 3 is fitted in and mounted to the trough 101, and as such, the rotating plate 3 matches, in shape and size, the trough 101. The rotating plate 3 is mounted in the trough 101 and connected with the cleaning plate 4, so that the rotating plate 3 and the cleaning plate 4 are exposed outside of the chassis 1 to carry out the function of cleaning. The trough 101 is shielded by the rotating plate 3 to prevent contaminants on the surface-to-be-cleaned from moving through the trough 101 to get into the cleaning device during the cleaning process to thereby reduce a situation where contaminant deposits and hides in the transmitting connection site between the cleaning plate 4 and the first drive mechanism 2 of the cleaning device to better protect product aesthetics and fulfill an effect of dust protection of product bottom side.

To fulfill the rotating plate 3 driving the cleaning plate 4 to move for displacement in order to expand the cleaning range of the cleaning device, the second drive mechanism 6 is connected with the rotating plate 3, so that as being driven by the second drive mechanism 6, the rotating plate 3 is caused to rotate about an axis of the rotating plate 3 to thereby drive the cleaning plate 4 to do the displacement movement. Since the cleaning plate 4 is arranged, in an eccentric manner, on the rotating plate 3, during the course that the second drive mechanism 6 drives the rotating plate 3 to rotate, the cleaning plate 4 can move along with the rotating plate 3 and form a movement trace that is offset from the axis of the rotating plate 3. As such, the cleaning plate 4 can do displacement movement relative to the chassis 1 to cover a broadened area of cleaning.

In a detailed example, during the process that the cleaning device is performing an operation of ground sweeping or mopping, when the cleaning device moves to a wall or a corner, the second drive mechanism 6 can be operated to drive the rotating plate 3 to spin so as to drive the cleaning plate 4 to rotate in an offset manner to allow the cleaning plate 4 to swing toward the wall and the cleaning plate 4 may then abut the wall to perform cleaning, thereby facilitating the cleaning operation performed by the cleaning device to cover a more broadened area, enabling fuller and more throughout cleaning of the target ground surface. During the above process of operation, as the rotating plate 3 is fit to and mounted in the trough 101 of the chassis 1, the rotating plate 3 can be driven by the second drive mechanism 6 to spin about itself to fulfill the displacement movement of the cleaning plate 4, avoiding defining an avoidance trough in the chassis 1 of the cleaning device to avoid interference with the movement trace of displacement of the rotating plate 3. Deposition of debris, such as dust and hairs, in the avoidance trough during the cleaning process, leading to an issue of increasing the burden of the user for cleaning, is avoided. Thus, the time that require cleaning with human labor can be greatly reduced and easiness and experience of use by the user can be enhanced.

Figure 4:
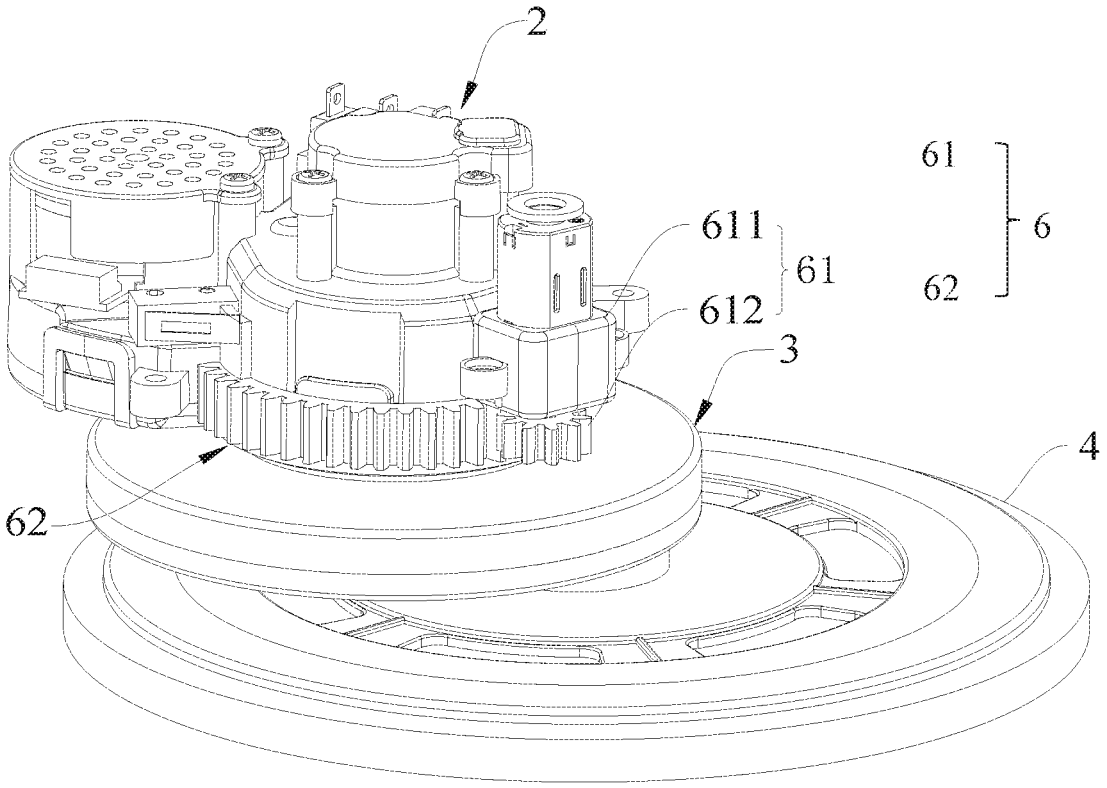
FIG. 4 is a schematic view showing a driving structure of a cleaning plate according to an embodiment of the application.
Figure 6:
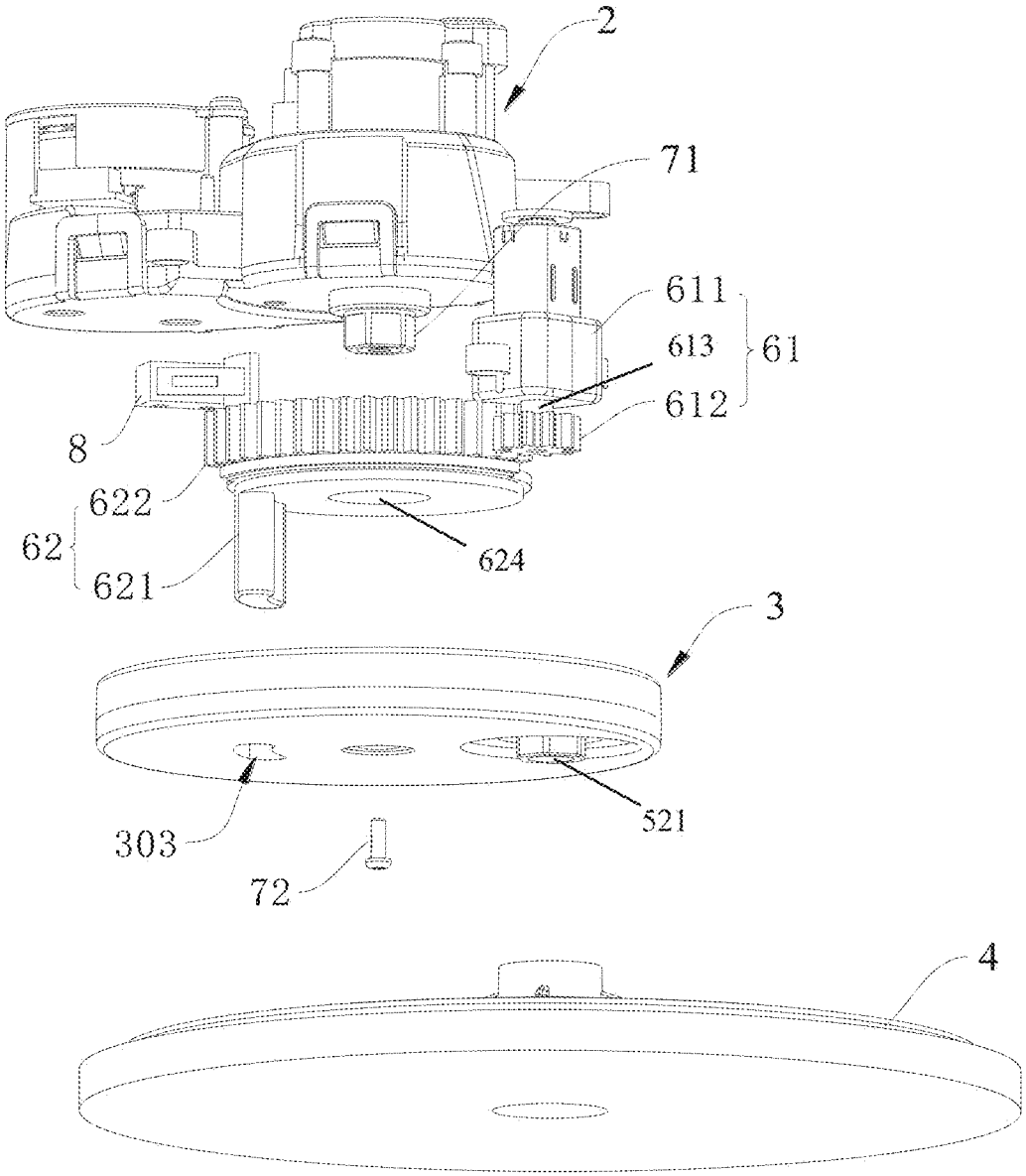
FIG. 6 is an exploded view showing a driving structure of a cleaning plate according to an embodiment of the application.
Figure 7:
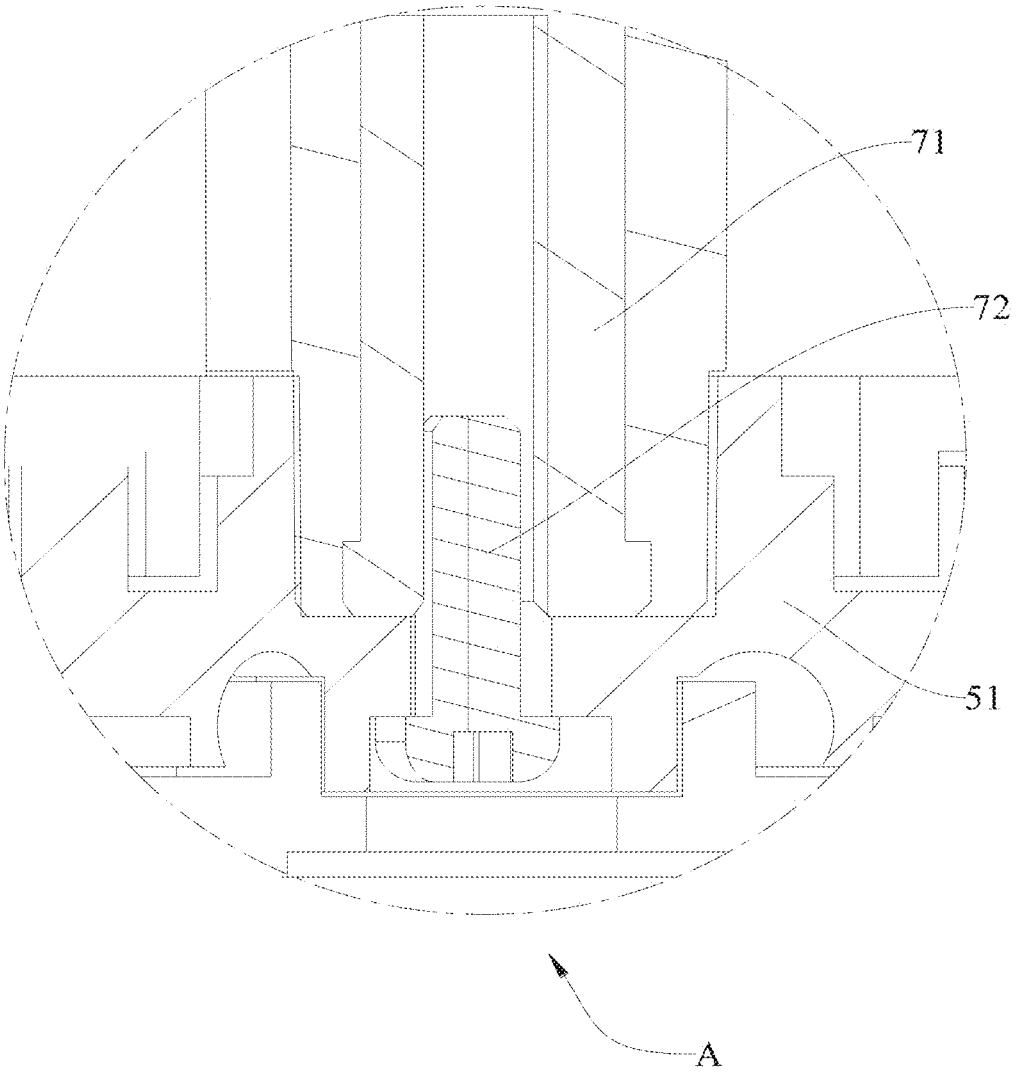
FIG. 7 is an enlarged view of part A of FIG. 5.
Figure 9:
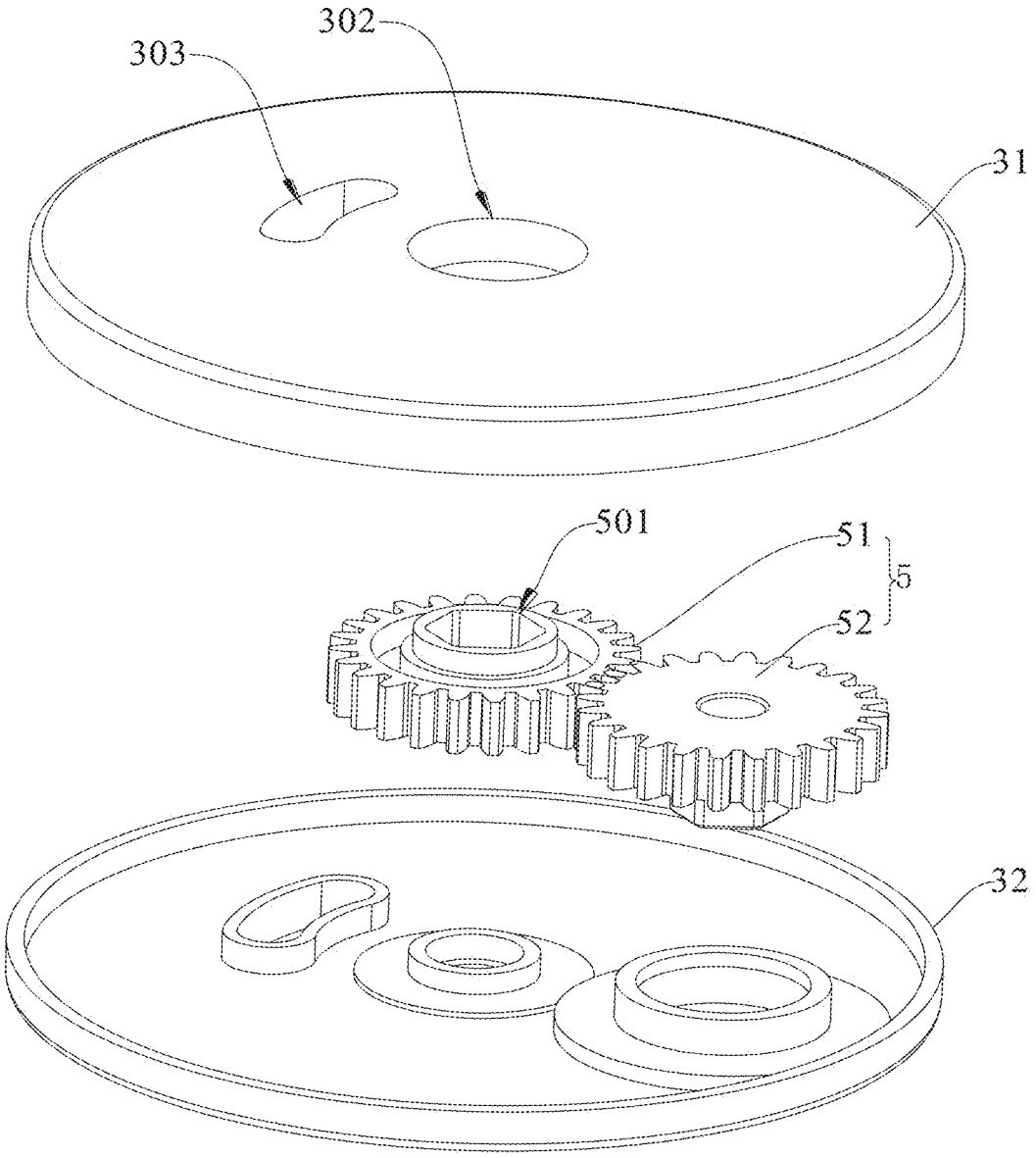
FIG. 9 is an exploded view showing a rotating plate according to an embodiment of the application.

As shown in FIGS. 4, 6, and 9, the rotating plate 3 is in the form of a circular plate, and the rotating plate 3 is formed with a receiving compartment 301. The transmission structure 5 is mounted in the receiving compartment 301. The input end of the transmission structure 5 is in transmitting connection with the first drive mechanism 2 to form a first coupling end, and the first coupling end is located at the axis of the rotating plate 3. The output end of the transmission structure 5 is in transmitting connection with the cleaning plate 4 to form a second coupling end, and the second coupling end is located between the axis and a circumference of the rotating plate 3.

As the cleaning plate 4 is arranged outside of the chassis 1, the transmission structure 5 is mounted in the receiving compartment 301 of the rotating plate 3 such that an outer casing of the rotating plate 3 can better protect the transmission structure 5, reducing interference of impurity with the transmission structure 5 during the cleaning process, enhancing stability and service life of the transmission structure 5 and also making the entirety of the transmission structure 5 more compact, reducing the space occupied thereby.

Further, the rotating plate 3 is in the form of a circular plate, and as shown in FIGS. 6 and 9. The form of circular plate can be regarded as a cylindrical form that is made up of a geometric body delimited and defined by two, upper and lower, circle end surfaces having identical sizes and parallel with each other, and a curved surface (a circumferential surface) connecting the two circle end surfaces. As such, during the course of being driven by the second drive mechanism 6 to rotate about the axis, the rotating plate 3 can still excellently shield the opening of the trough, making the rotating plate and the trough better matching each other in the assembly thereof. The arrangement of circular plate allows a mounting configuration between the rotating plate and the chassis of the cleaning device more compact.

The input end of the transmission structure 5 connecting with the first drive mechanism 2 forms the first coupling end, and the first coupling end is arranged on the axis of the rotating plate 3, so that when the second drive mechanism 6 drives the rotating plate 3 to rotate, the transmission structure 5 arranged in the rotating plate 3 and the first drive mechanism 2 are kept in transmitting connection with each other on the axis of the rotating plate 3 to provide an effect of supporting for the motion of the rotating plate 3 rotating about the axis thereof. Further, the output end of the transmission structure 5 in transmitting connection with the cleaning plate 4 forms the second coupling end, which is arranged between the axis of the rotating plate 3 and the circumference of the rotating plate 3. This ensures that the rotating plate 3, when rotating about the axis thereof, drives the cleaning plate 4 to move for displacement. Compared with a complicated crankarm or link rod based mechanism, the transmission structure 5 of the application greatly simplifies the movement trace, reduces complication of movement, and also ensure continuity and stability of the rotation of the cleaning plate 4 during the course that the rotating plate 3 drives the cleaning plate 4 to move for displacement.

Specifically, a first connection hole 302 is defined at the axis of the rotating plate 3, and the first drive mechanism 2 comprises an output axle 71. The output axle 71 extends through the first connection hole 302 to be in transmitting connection with the input end of the transmission structure 5 to form the first coupling end. By forming the first connection hole 302 in the axial center of the rotating plate 3, a portion of the output axle 71 which extends through the first connection hole 302 to enter into the receiving compartment 301 of the rotating plate 3 is in transmitting connection with the input end of the transmission structure 5 to realize driving the cleaning plate 4 to rotate to achieve the function of cleaning. On the other hand, the output axle 71 serves as a rotation center point of the rotating plate 3, providing a stable support for movement of the rotating plate 3 and reducing oscillation or shifting of the rotating plate 3 during the course of rotation.

Further, the second drive mechanism 6 comprises the driving member 61 and the rotating member 62. The rotating member 62 is fitted outside of the output axle 71, and the rotating member 62 is connected to the rotating plate 3. The driving member 61 is configured to drive the rotating member 62 to rotate about the output axle 71 to drive the rotating plate 3 to rotate relative to the output axle 71. The rotating member 62 is fitted outside of the output axle 71, and the rotating member 62 is formed with a through hole 624, the through hole 624 being arranged to correspond to the first connection hole 302 arranged in the center axis of the rotating plate 3, so as to allow the output axle 71 to penetrate, in sequence, through the through hole 624 of the rotating member 62 and the first connection hole 302 of the rotating plate 3, to thereby make the structure of the second drive mechanism 6 and the rotating member 62 more compact. Further, the driving member 61 is operable to drive the rotating member 62 to rotate about the output axle 71. For example, the driving member 61 comprises an electric motor 611, and the electric motor 611, upon being supplied with electrical power, drives the rotating plate 3 to move relative to the output axle 71 to help the cleaning device to better adapt to various cleaning surfaces and corners, facilitating reduction of dead zones of cleaning to thus increase the cleaning efficiency.

In a technical solution of the present invention, the rotating member 62 comprises a connecting portion 621, and the rotating plate 3 is formed with a connection slot 303. The connecting portion 621 is received in the connection slot 303 such that the rotating member 62 is capable of driving the rotating plate 3 to rotate therewith. The connection slot 303 is eccentrically arranged in the rotating plate 3, that is, the center of the connection slot 303 is offset from the center of the rotating plate 3. The connecting portion 621 of the rotating member 62 is fitted in the connection slot 303 of the rotating plate 3 such that the rotating member 62 and the rotating plate 3 are connected together to thereby allow the rotating member 62 to drive the rotating plate 3 to rotate.

Figure 5:
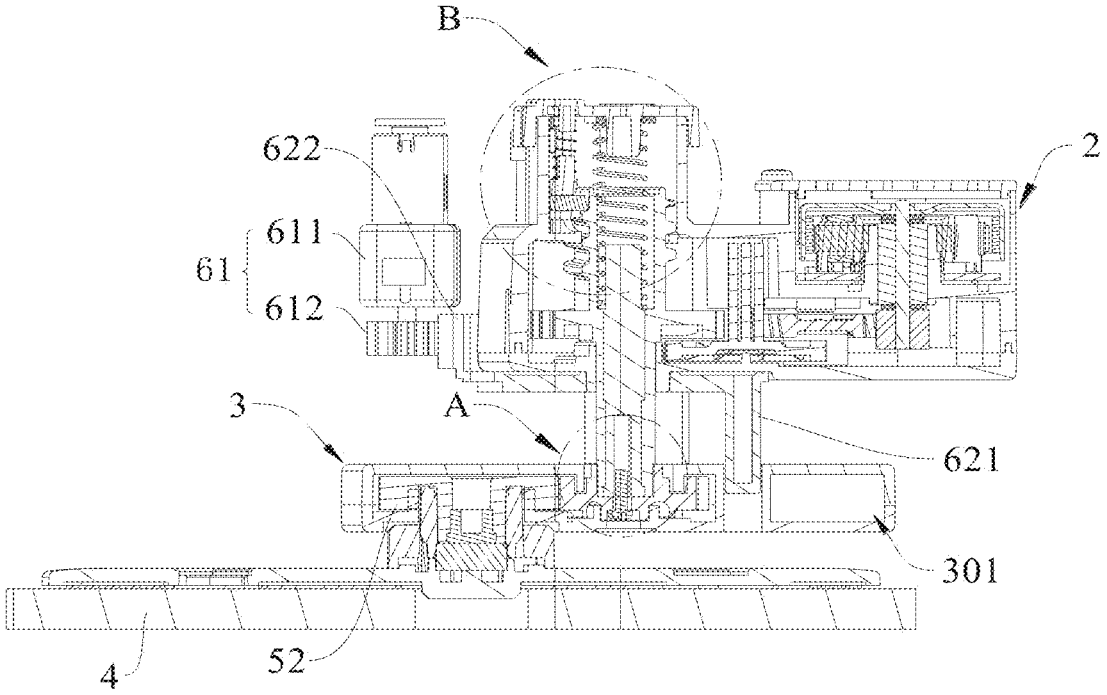
FIG. 5 is a cross-sectional view showing a driving structure of a cleaning plate according to an embodiment of the application.

As shown in FIGS. 2 and 5, the connecting portion 621 projects in a direction toward the connection slot 303 of the rotating plate 3. The connection slot 303 is of a curved form, and correspondingly, a portion of the connecting portion that is inserted into the connection slot is also of a curved form. This increases the area of connection between the connecting portion 621 and the connection slot 303, increasing the mechanical strength of the connecting portion to drive the rotating plate 3 to rotate and enhancing reliability and durability of the mechanical transmission.

In other embodiments, a snap-fitting structure may be arranged between the connecting portion 621 and the connection slot 303 of the rotating plate 3 to fix the connection between the two, or alternatively, fasteners, such as bolts and screws, may be used to fixedly connect the two, or alternatively, threading connection may be adopted between the connecting portion 621 and a wall of the connection slot 303 for enhancing fixing therebetween to thereby improve stability and reliability of the transmitting connection between the second drive mechanism 6 and the rotating plate 3.

In a technical solution of the present invention, the rotating member 62 comprises a meshing portion 622, while the output axle 613 of the driving member 61 is provided with a first toothed wheel 612. The first toothed wheel 612 is meshed and in transmitting connection with the meshing portion 622. The meshing between the rotating member 62 and the driving member 61 fulfills motion transmission therebetween. Specifically, the driving member 61 comprises a first toothed wheel 612 and an electric motor 611. The first toothed wheel 612 is arranged on an output axle 613 of the electric motor 611. The electric motor 611, when in operation, drives the first toothed wheel 612 to rotate, and the meshing engagement between the first toothed wheel 612 and the meshing portion 622 ensures that the power of the driving member 61 can be accurately transmitted to the rotating member 62 to fulfill stable operation of the rotating member 62 and the rotating plate 3.

In a technical solution of the present invention, the transmission structure 5 comprises a first transmission gear 51 and a second transmission gear 52 that are in transmitting connection with each other. The first transmission gear 51 functions as the input end of the transmission structure 5 and is in transmitting connection with the output axle 71, and the second transmission gear 52 serves as the output end of the transmission structure 5 and is in transmitting connection with the cleaning plate 4. Specifically referring to FIG. 9, the first transmission gear 51 is connected to the output axle 71 to serve as the input end of the transmission structure 5, and the second transmission gear 52 is connected to the cleaning plate 4 to serve as the output end of the transmission structure 5, so that through the meshing engagement between the first transmission gear 51 and the second transmission gear 52, gear-based transmission of high performance and stability from the first drive mechanism 2 to the cleaning plate 4 is realized to ensure accuracy and continuity of transmission of power to reduce loss of energy.

Further, a ratio relationship between the first transmission gear 51 and the second transmission gear 52 may be adjusted to suit the needs for various speeds and torques, and further, the number of the transmission gears can be designed according to the need for transmitting motion. Further, the gear based transmission structure 5 is relatively simple and, compared to other ways of transmission, such as belt and chain, is more robust and can thus enhance the durability and stability of the entirety of the cleaning device. The gear based transmission structure 5 occupies a space that the relatively small.

Figure 8:
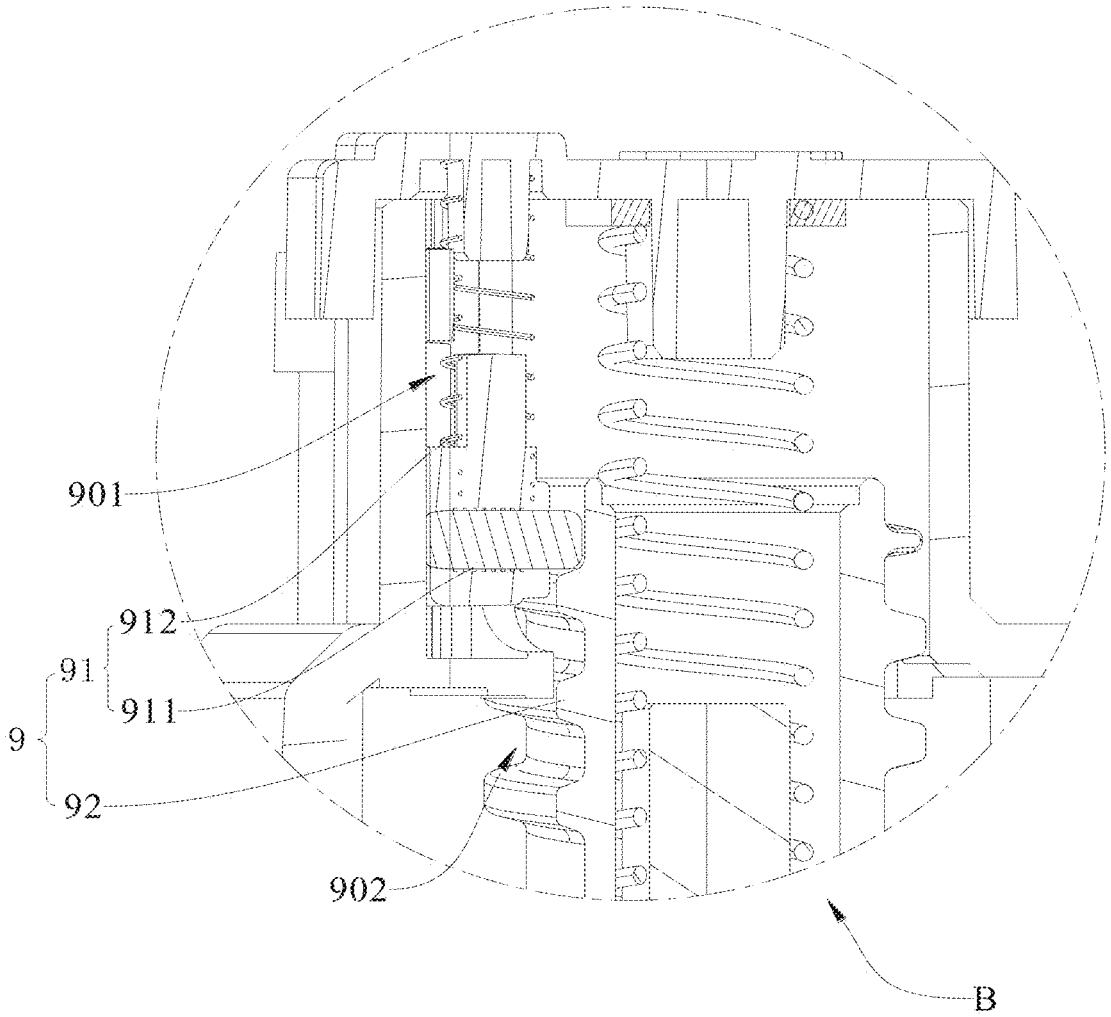
FIG. 8 is an enlarged view of part B of FIG. 5.

In a technical solution of the present invention, a connecting member 72 is further included. The first transmission gear 51 is formed with a second connection hole 501, and the second connection hole 501 is arranged to correspond to the first connection hole 302. The output axle 71 extends into the second connection hole 501, and the connecting member 72 extends through the second connection hole 501 to fixedly connect the output axle 71 and the first transmission gear 51. Referring to FIGS. 5 and 8, by forming the second connection hole 501 in the first transmission gear 51, a portion of the output axle 71 that extends through the first connection hole 302 of the rotating plate 3 can extend into the second connection hole 501 to establish connection between the output axle 71 and the input end of the transmission structure 5. For the purposes of further fixing the connection structure between the output axle 71 and the transmission structure 5, the connecting member 72 is so arranged as to extend through the second connection hole 501 to fulfill connection and fixing between the output axle 71 and the first transmission gear 51, reducing shifting of the first transmission gear 51 or the output axle 71 resulting from stress or vibration induced in the course of a cleaning operation performed by the cleaning device. The arrangement of the connecting member 72 ensures secured connection between the first transmission gear 51 and the output axle 71, reducing the chance of performance deterioration or malfunctioning resulting from unsecureness thereby enhancing the stability and reliability of the entirety of the cleaning device.

Illustratively, the connecting member 72 discussed above may be a bolt or a nut. Referring to FIGS. 2 and 9, the rotating plate 3 comprises an upper casing member 31 and a lower casing member 32 that are arranged to correspond to each other in an up-down direction. The first connection hole 302 extends through the upper casing member 31 and the lower casing member 32 along the axis thereof. The first transmission gear 51 is arranged in a space enclosed by the upper casing member 31 and the lower casing member 32. The output axle 71 extends from the first connection hole 302 of the upper casing member and reach into the interior of the second connection hole 501 of the first transmission gear 51. By arranging a bolt in the connection formed in the first transmission gear 51 by the second connection hole 501, a fixed connection can be formed between the first transmission gear 51 and the output axle 71.

It is further noted that the application uses the connecting member 72 to connect and fix the output axle 71 and the first transmission gear 51 together, and as the rotating member 62 is supported on the chassis 1 and receives the output axle 71 to penetrate therethrough, this provides that it is only necessary to have the connecting portion 621 of the rotating member 62 inserted in the connection slot 303 of the rotating plate 3, and there is no need to arrange extra fixing structure between the connecting portion 621 and the rotating plate 3 and the connection and fixing between the output axle 71 and the first transmission gear 51 suffices to fulfill an effect that the connecting portion 621 is movable without departing from the connection slot 303, and thus reducing structure complication of the transmission structure.

Illustratively, the second connection hole 501 formed in the first transmission gear 51 has an inside surface that is formed with corners, and correspondingly, an outside surface of the output axle 71 is formed with corners matching the inside surface of the second connection hole 501. Referring to FIG. 9, the second connection hole 501 is in the form of a polygonal hole for example a hexagonal hole, and correspondingly, the output axle 71 has a polygonal cross section for example a hexagonal cross section matching with the cross section of the hexagonal hole. This excellently prevent relative rotation occurring between the output axle 71 and the first transmission gear 51 during the course of transmitting motion and avoids noises caused by relative movement between the two during the course of motion thereby improving reliability of transmitting motion.

Similarly, the second transmission gear 52 is made similar to the first transmission gear 51 by providing, in an inside surface thereof, with a connection aperture 521 having corners, and the cleaning plate 4 is also provided with a protrusion peg 41, wherein the protrusion peg 41 is inserted into the connection aperture 521 of the second transmission gear 52, and an outside surface of the protrusion peg 41 is provided with ribs 42 that match the inside surface of the connection aperture to thereby avoid shifting of the second transmission gear 52 and the cleaning plate 4 during the course of transmitting motion and thus enhancing accuracy of transmission of motion.

In a technical solution of the present invention, one of the second transmission gear 52 and the cleaning plate 4 is provided with a first magnetic attraction portion, while another one of the second transmission gear 52 and the cleaning plate 4 is provided with a second magnetic attraction portion. Magnetic attraction is established between the first magnetic attraction portion and the second magnetic attraction portion to have the second transmission gear 52 and the cleaning plate 4 connected. Providing the first magnetic attraction portion and the second magnetic attraction portion respectively on the second transmission gear 52 and the cleaning plate 4 for the purposes of connecting through magnetic attraction makes mounting and detaching of the second transmission gear 52 and the cleaning plate 4 very easy and efficient. As the cleaning plate 4 is considered a consumable part that is very easy to damage during the course of a cleaning operation of the cleaning device, the magnetic attraction based detachable arrangement is very convenient for the user. In case of replacing or servicing the cleaning plate 4, it only needs to break the magnetic attracting connection and no tool or any complicated dismounting operation is needed, thereby simplifying the servicing operation. Further, magnetic attraction connection may tolerate, to some extents, minor deviation for self-adaption, thereby ensuring secured connection between the second transmission gear 52 and the cleaning plate 4. This helps reduce wear or vibration resulting from being uncentered.

Of course, the application does not limit the connection between the second transmission gear 52 and the cleaning plate 4 to being realized with magnetic attraction, and other measures of detachable coupling may be taken for connection between the second transmission gear 52 and the cleaning plate 4, such as snap fitting and screw connection to fulfill the detachable structure between the cleaning plate 4 and the rotating plate 3 for allowing the user to directly replace the cleaning plate 4.

In a technical solution of the present invention, the meshing portion 622 comprises a first end and a second end arranged in a circumferential direction of the rotating member 62. The "first end" refers to a part of the meshing portion 622 which meshes with the first gear 612 when the cleaning plate 4 is fully retracted under the chassis 1. The "second end" refers to a part of the meshing portion 622 which meshes with the first gear 612 when the cleaning plate 4 is driven to move outwardly beyond the chassis 1. The cleaning device further comprises a position sensor 8 arranged on the meshing portion 622. Preferably, the position sensor 8 is arranged on a part of the meshing portion 622 adjacent to the second end. The position sensor 8 is connected, for electrical controlling, with the driving member 61, in order to detect a rotation position of the meshing portion 622, so as to control and cut off supply of electrical power to the driving member 61 when the second end of the meshing portion 622 meshes with the first toothed wheel 612. By arranging the position sensor 8 on the meshing portion 622, when the meshing portion 622 reaches the preset position, the position sensor 8 issues a signal to the driving member 61 to cut off supply of electrical power thereto so as to ensure that the second end of the meshing portion 622 stops at an accurate position, and thus, the rotating plate 3 driven by the transmitting member can ensure, through the arrangement of the position sensor 8, the cleaning plate 4 is driven and stopped at an accurate position. As such, the cleaning plate 4, when driven by the second drive mechanism 6 to move for displacement to extend out of the chassis 1, may carry out cleaning operation at site alongside a wall, and at this moment, the driving member 61 drives the second end of the meshing portion 622 to rotate to such a preset position, and the position sensor 8 detects the position of the meshing portion 622 to control the driving member 61 to stop driving. This makes the cleaning plate 4 kept at a position of being extending out of the chassis 1.

The arrangement of the position sensor 8 enable accurate detection of the position of the meshing portion 622, thereby enhancing motion accuracy of the cleaning plate 4 and also preventing overdriving of the meshing portion 622 by the driving member 61 in such that when the meshing portion 622 reaches the preset position, the driving member 61 immediately cut off the supply of electrical power thereto to thereby prevent mechanical damage or performance deterioration resulting from overdriving.

As shown in FIGS. 4 and 6, the meshing portion 622 can be a toothed rack in the form of a ring. The driving member 61 is fixedly mounted on the cleaning device, and mating is formed between the transmitting member and the meshing portion 622 for transmission so as to drive the meshing portion 622 to move. The position sensor 8 is arranged at an end portion of the meshing portion 622, and as such, when the transmitting member is meshed with an end of the meshing portion 622 approaching the position sensor 8, the position sensor 8 is capable of detecting the transmitting member and sending a signal to the driving member 61 to thereby control the driving member 61 to cut off the supply of electrical power.

For example, the position sensor 8 can be a Hall sensor, an infrared sensor, or a microswitch, and understandably, the driving member 61 may receive a detection signal generated by the position sensor 8.

In a technical solution of the present invention, the chassis 1 comprises a partition plate 11, and the partition plate 11 functions for dividing and defining an internal mounting space of the cleaning device. The partition plate 11 is recessed to form the trough 101, and the trough 101 is located outside of the internal mounting space of the cleaning device. The partition plate 11 is formed with a connection opening 102. The first drive mechanism 2 and the second drive mechanism 6 are both mounted in the internal mounting space of the cleaning device. The connecting portion 621 extends through the connection opening 102 to connect to the rotating plate 3.

In the above, the chassis 1 uses the arrangement of the partition plate 11 to realize partitioning of the internal mounting space of the cleaning device, and the first drive mechanism 2 and the second drive mechanism 6 can be mounted, in a compact manner, in the internal mounting space. The partition plate 11 is recessed toward an outside of the internal mounting space to form the trough 101, and this provide an extra space of storage or mounting for the rotating plate 3, so as to make the rotating plate 3 adaptively mounted in the trough 101.

Further, the partition plate 11 is formed with the connection opening 102, and the arrangement of the connection opening 102 allows the output axle 71 of the first drive mechanism 2 to extend outwards from the internal mounting space of the cleaning device to reach the interior of the trough 101, so as to be set in transmitting connection with the transmission structure 5 arranged in the rotating plate 3. The transmitting member of the second drive mechanism may also extend outwards through the connection opening 102 to reach into the interior of the trough 101 for connection with the rotating plate 3 to drive the rotating plate 3 to rotate.

It is noted that the shape and size of the rotating plate 3 match the shape and size of the opening of the trough 101. Being driven by the second drive mechanism 6, the rotating plate 3 only needs to rotate about the axis thereof in order to fulfill driving of the cleaning plate 4 to move for displacement. The location where the rotating plate 3 is mounted on the partition plate 11 is fixed, and this avoids forming an avoidance trough in the partition plate 11 to preserve a space for a motion trace of the cleaning plate 4 driven by the rotating plate 3 to move for displacement. The application provides the transmission structure 5 so as to prevent movement for displacement of the rotating plate 3 that drives the cleaning plate 4 to rotate, and the arrangement of the rotating plate 3 can directly shield the opening of the trough 101 to thereby greatly reduce a situation that contaminants on the surface-to-be-cleaned pass through the trough 101 to get into the interior of the cleaning device during a cleaning process, providing an effect of dust protection and contamination protection for the bottom side.

In a technical solution of the present invention, the cleaning device further comprises an elevation mechanism 9. The elevation mechanism 9 is connected with the first drive mechanism 2. The elevation mechanism 9 is configured to drive the cleaning plate 4 to ascend or descend. When the first drive mechanism 2 performs transmitting with respect to the transmission structure 5 in a first direction, the elevation mechanism 9 drives the cleaning plate 4 to ascend, and when the first drive mechanism 2 performs transmitting with respect to the transmission structure 5 in a second direction, the elevation mechanism 9 drives the cleaning plate 4 to descend. When the elevation mechanism 9 drives the cleaning plate 4 to descend to a lowest position, the rotating plate 3 is located in the trough 101. By arranging the elevation mechanism 9 to connect with the first drive mechanism 2, the elevation mechanism 9 may self-adjust according to the direction of the first drive mechanism 2, in order to fulfill the function of ascending/descending for the cleaning plate 4. When the first drive mechanism 2 performs transmission in the first direction with respect to the transmission structure 5, the elevation mechanism 9 drives the cleaning plate 4 to ascend; and when the first drive mechanism 2 performs transmission in the second direction with respect to the transmission structure 5, the elevation mechanism 9 drives the cleaning plate 4 to descend, and as such, when the cleaning device detects a carpet existing on the ground surface to be cleaned, the first drive mechanism 2 can be driven in the first direction to drive the elevation mechanism 9 and the cleaning plate 4 upwards, avoiding wetting or staining the carpet, or when the cleaning device has completed cleaning of an area and is returning to a base station, the above-described measures may be taken to make the cleaning plate 4 ascending to prevent the cleaning plate 4 from causing staining on the ground surface again. When the cleaning tray needs to clean the ground surface, the first drive mechanism 2 performs transmission in the second direction with respect to the cleaning plate 4, to thereby drive the cleaning plate 4 to descend to the cleaning surface to complete the cleaning task.

In the above, to adapt to the motion of the elevation mechanism 9 driving the cleaning plate 4 to ascend and descend, the depth of the trough 101 is designed according to the distance that the rotating plate 3 is synchronously driven to ascend or descend, and as such, when the elevation mechanism 9 drives the cleaning plate 4 and the rotating plate 3 to descend to a lowest position, the rotating plate 3 may still shield the opening of the trough 101. As shown in FIG. 2, the cleaning plate 4 is driven by the elevation mechanism 9 to be set in a descending condition, the rotating plate 3 is at least partly located in the trough 101, preventing contaminant from depositing and hiding in the trough 101 or preventing external moisture from passing through the trough 101 to get into the internal mounting space, and it only needs the rotating plate 3 to be partly located in the trough 101.

Illustratively, referring to FIGS. 2, 3, and 5, the first drive mechanism 2 can be a transmission box. The transmission box in provided, in an interior thereof, with a driver motor. An output end of the driver motor and the output axle 71 arranged in the first drive mechanism 2 are set in transmitting connection through gears. In this, the elevation mechanism 9 comprises a position-limiting unit 91 and an axial displacement unit 92. The axial displacement unit 92 is arranged on the output axle 71. The axial displacement unit 92 is formed with a slide chute 902. The position-limiting unit 91 is at least partly received in the slide chute 902 and is capable of moving along the slide chute 902. When the first drive mechanism 2 performs transmission in the first direction with respect to the transmission structure 5, meaning the output axle 71 performing transmission in the first direction with respect to the transmission structure 5, the position-limiting unit 91 is slidable along the slide chute 902 of the axial displacement unit 92 to thereby drive the output axle 71 to ascend, and the rotating plate 3 and the cleaning plate 4 are synchronously driven by the output axle 71 to ascend, and similarly, the elevation mechanism 9 drives the motion of the cleaning plate 4 with the same principle as described above.

In a more detailed illustration, the axial displacement unit 92 is arranged as a screw rod on the output axle 71, having a surface forming the slide chute 902 helically extending on the surface of the screw rod. The position-limiting unit 91 is in mating engagement with the slide chute 902 to form a structure of slidable engagement.

In some embodiments, the position-limiting unit 91 of the elevation mechanism 9 comprises a slide block 911 and an elastic member 912. An internal positioning groove 901 is defined in the mounting space of the first drive mechanism 2. The slide block 911 is movably disposed in the positioning groove 901. The slide block 911 is connected to one end of the elastic member 912, and another end of the elastic member 912 is supported on a top wall of the positioning groove 901, and as such, the slide block 911 is allowed to move in the positioning groove 901. Understandably, the arrangement of the positioning groove 901 fulfills limiting to the motion of ascending and descending of the slide block 911.

The application provides, in a second aspect, in an embodiment, with a control method of a cleaning device, which is applicable to the cleaning device described in any one of the above-illustrated embodiments. The control method comprises: supplying electrical power to the first drive mechanism 2 according to a first mode instructed by a mode instruction so as to have the transmission structure 5, on the basis of being driven by the first drive mechanism 2, driving the cleaning plate 4 to rotate.

Specifically, the first mode refers to a process of the cleaning plate 4 of the cleaning device performing cleaning on a ground surface. When a user needs cleaning, the cleaning device follows the mode instruction receives to supply electrical power, under the instruction of the first mode, toward the first drive mechanism 2, and at this moment, the electric motor of the first drive mechanism 2, as being supplied with electrical power, drives the transmission structure 5 to move and thus drive the cleaning plate 4 to rotate, thereby fulfilling the function of surface sweeping or surface mopping.

Further, it is also feasible to adjust the time and intensity of supplying electrical power of the first drive mechanism 2, in order to control the rotating speeds and directions of the transmission structure 5 and the cleaning plate 4 to realize high-performance and full cleaning.

In some embodiments, the control method further comprises: supplying electrical power to the first drive mechanism 2 and the second drive mechanism 6 according to a second mode instructed by a mode instruction, so as to have the transmission structure 5, on the basis of being driven by the first drive mechanism 2, driving the cleaning plate 4 to rotate and to have the rotating plate 3, on the basis of being driven by the second drive mechanism 6, driving the cleaning plate 4 to move for displacement.

Specifically, the second mode refers to a process of the cleaning device performing an operation of surface sweeping or surface mopping, and during such a process, electrical power is simultaneously supplied to the first drive mechanism 2 and the second drive mechanism 6 to simultaneously drive the transmission structure 5 and the rotating plate 3 to fulfill motions of rotation and displacement of the cleaning plate 4. More specifically, it is learned, when combining with the above embodiments, that the second drive mechanism 6 drives the rotating plate 3 to spin so as to drive the cleaning plate 4 eccentrically rotate to thereby make the cleaning plate 4 oscillating toward a wall, allowing the cleaning plate 4 to clean alongside the wall, allowing the cleaning operation of the cleaning device to cover a broadened area, making it cleaning a target surface in a fuller and more throughout way, and also, the first drive mechanism, through the transmitting connection with the transmission structure, drives the cleaning plate 4 to spin for cleaning the ground surface.

In some embodiments, an elevation mode is further included. When the cleaning device needs to pass over a carpet or any other situation that requires no contact of the cleaning plate with a cleaning surface, the first drive mechanism 2 is controlled to rotate in a rotation direction opposite to the cleaning plate 4 under the first mode, so as to have the elevation mechanism 9 driving the cleaning plate 4 to ascend, preventing contamination caused by direct contact with the moving surface.

It is appreciated that for those having ordinary skill in the art, equivalent substitutions or alterations can be made according to the technical solutions and inventive idea of the present invention, and such alterations and substitutions are all considered within the scope of protection of the present invention.

What is claimed is:

1. A cleaning device, comprising:

a chassis, the chassis being recessed to form a trough;

a first drive mechanism comprising a first motor, the first drive mechanism being mounted on the chassis;

a rotating plate and a cleaning plate, the rotating plate being fitted to and mounted in the trough, the cleaning plate being eccentrically mounted to the rotating plate, the rotating plate being provided with a receiving compartment and a transmission structure mounted in the receiving compartment, an input end of the transmission structure being in transmitting connection with the first drive mechanism, an output end of the transmission structure being in transmitting connection with the cleaning plate to drive the cleaning plate to rotate; and a second drive mechanism comprising a second motor, the second drive mechanism being connected with the rotating plate, wherein driven by the second drive mechanism, the rotating plate is caused to rotate about an axis of the rotating plate, so that the rotating plate drives, through rotation thereof, the cleaning plate to move for displacement.

2. The cleaning device according to claim 1, wherein the rotating plate is in the form of a circular plate, and the input end of the transmission structure being in transmitting connection with the first drive mechanism to form a first coupling end, the first coupling end being located on the axis of the rotating plate, the output end of the transmission structure being transmitting connection with the cleaning plate to form a second coupling end, the second coupling end being located between the axis of the rotating plate and a circumference of the rotating plate.

3. The cleaning device according to claim 2, wherein a first connection hole is formed in an axial center of the rotating plate, the first drive mechanism comprising an output axle, the output axle extending through the first connection hole to be in transmitting connection with the input end of the transmission structure to form the first coupling end; and the second drive mechanism comprises a driving member and a rotating member, the driving member comprising the second motor, the rotating member being fitted outside of the output axle, the rotating member being connected to the rotating plate, the driving member being configured to drive the rotating member to rotate about the output axle to drive the rotating plate to rotate relative to the output axle.

4. The cleaning device according to claim 3, wherein the rotating member comprises a connecting portion, the rotating plate is formed with a connection slot, and the connecting portion is fit in the connection slot to drive the rotating plate to rotate; and the rotating member comprises a meshing portion, the output axle of the driving member is provided with a first toothed wheel, and the first toothed wheel is meshed with the meshing portion.

5. The cleaning device according to claim 4, wherein the connecting portion protrudes from a side of the meshing portion facing the rotating plate; and the connection slot is of a curved form, and correspondingly, a part of the connecting portion that is inserted into the connection slot is also of a curved form.

6. The cleaning device according to claim 3, wherein the transmission structure comprises a first transmission gear and a second transmission gear that are in transmitting connection with each other, the first transmission gear serving as the input end of the transmission structure and in transmitting connection with the output axle, the second transmission gear serving as the output end of the transmission structure and in transmitting connection with the cleaning plate.

7. The cleaning device according to claim 6, further comprising a connecting member, wherein the first transmission gear is formed with a second connection hole, the second connection hole is arranged to be aligned with the first connection hole, the output axle extends into the second connection hole, the connecting member extends through the second connection hole to fixedly connect the output axle and the first transmission gear to each other.

8. The cleaning device according to claim 7, wherein the rotating plate comprises an upper casing member and a lower casing member facing each other in an up-down direction; the first connection hole extends through the upper casing member; the first transmission gear is arranged in a space enclosed by the upper casing member and the lower casing member; and the output axle extends downwardly through the first connection hole of the upper casing member and into the second connection hole of the first transmission gear.

9. The cleaning device according to claim 7, wherein the second connection hole is a polygonal hole, and correspondingly, the output axle has a polygonal cross section matching with that of the second connection hole.

10. The cleaning device according to claim 7, wherein the second transmission gear defines a connection aperture, and the cleaning plate is provided with a protrusion peg which is inserted into the connection aperture of the second transmission gear, and an outside surface of the protrusion peg is provided with ribs that match an inside surface of the connection aperture to thereby avoid shifting of the second transmission gear and the cleaning plate during a course of transmitting motion.

11. The cleaning device according to claim 6, wherein one of the second transmission gear and the cleaning plate is provided with a first magnetic attraction portion, and another one of the second transmission gear and the cleaning plate is provided with a second magnetic attraction portion, the first magnetic attraction portion and the second magnetic attraction portion being connectable through magnetic attraction therebetween to have the second transmission gear connected to the cleaning plate.

12. The cleaning device according to claim 4, wherein the meshing portion comprises a first end and a second end arranged in a circumferential direction of the meshing portion, and the cleaning device further comprises a position sensor arranged on the meshing portion, the position sensor being electrically connected with the driving member and configured to detect a position of the meshing portion.

13. The cleaning device according to claim 12, wherein the meshing portion is a toothed rack in a form of a ring, the driving member is fixedly mounted on the cleaning device, the transmitting member is meshed with the meshing portion, and the position sensor is arranged at the second end of the meshing portion so as to control the driving member to cut off supply of electrical power thereto when the second end of the meshing portion meshes with the first toothed wheel.

14. The cleaning device according to claim 4, wherein the chassis comprises a partition plate which is configured to divide and define an internal mounting space of the cleaning device, the partition plate being recessed to form the trough, the trough being located outside of the internal mounting space of the cleaning device, the partition plate being formed with a connection opening, the first drive mechanism and the second drive mechanism being both mounted in the internal mounting space of the cleaning device, the connecting portion extending through the connection opening to connect with the rotating plate.

15. The cleaning device according to claim 14, wherein the connection opening is configured to allow the output axle of the first drive mechanism to extend outwards from the internal mounting space of the cleaning device to reach an interior of the trough so as to be set in transmitting connection with the transmission structure arranged in the rotating plate, and the transmitting member of the second drive mechanism extends outwards through the connection opening to reach into the interior of the trough for connection with the rotating plate to drive the rotating plate to rotate.

16. A cleaning device, comprising:

a chassis, the chassis being recessed to form a trough;

a first drive mechanism comprising a first motor, the first drive mechanism being mounted on the chassis;

a rotating plate and a cleaning plate, the rotating plate being fitted to and mounted in the trough, the cleaning plate being eccentrically mounted to the rotating plate, the rotating plate being provided with a transmission structure, an input end of the transmission structure being in transmitting connection with the first drive mechanism, an output end of the transmission structure being in transmitting connection with the cleaning plate to drive the cleaning plate to rotate;

a second drive mechanism comprising a second motor, the second drive mechanism being connected with the rotating plate, wherein driven by the second drive mechanism, the rotating plate is caused to rotate about an axis of the rotating plate, so that the rotating plate drives, through rotation thereof, the cleaning plate to move for displacement; and an elevation mechanism, wherein the elevation mechanism is connected with the first drive mechanism and configured to drive the cleaning plate to ascend or descend;

when the first drive mechanism performs transmission in a first direction with respect to the transmission structure, the elevation mechanism drives the cleaning plate to ascend, and when the first drive mechanism performs transmission in a second direction with respect to the transmission structure, the elevation mechanism drives the cleaning plate to descend; and when the elevation mechanism drives the cleaning plate to descend to a lowest position, the rotating plate is located in the trough.

17. The cleaning device according to claim 16, wherein the elevation mechanism comprises a position-limiting unit and an axial displacement unit, the axial displacement unit is arranged on the output axle, the axial displacement unit is formed with a slide chute, the position-limiting unit is at least partly received in the slide chute and is capable of moving along the slide chute;

when the first drive mechanism performs transmission in a first direction with respect to the transmission structure, the position-limiting unit is slidable along the slide chute of the axial displacement unit to thereby drive the output axle to ascend, and the rotating plate and the cleaning plate are synchronously driven by the output axle to ascend.

18. The cleaning device according to claim 17, wherein the axial displacement unit is configured as a screw rod on the output axle, having a surface forming the slide chute helically extending thereon, and the position-limiting unit is in mating engagement with the slide chute.

19. The cleaning device according to claim 17, wherein the position-limiting unit of the elevation mechanism comprises a slide block and an elastic member, an internal positioning groove is defined in the first drive mechanism, and the slide block is movably disposed in the positioning groove, the slide block is connected to one end of the elastic member and another end of the elastic member abuts against a top wall of the positioning groove to thereby allow the slide block to move in the positioning groove.

* * * * *